United States Patent [19]

Dobashi et al.

[11] Patent Number: 4,544,573

[45] Date of Patent: Oct. 1, 1985

[54] PROCESS FOR CURING RADIATION CURABLE COATING MEDIA

[75] Inventors: Akihiko Dobashi; Tomohisa Ohta; Hirotsugu Himori, all of Shimodate; Hideo Sekine, Oyama, all of Japan

[73] Assignee: Hitachi Chemical Company, Ltd., Tokyo, Japan

[21] Appl. No.: 674,326

[22] Filed: Nov. 23, 1984

[30] Foreign Application Priority Data

Nov. 24, 1983 [JP] Japan ..... 58-221052

[51] Int. Cl.[4] ..... B05D 3/06

[52] U.S. Cl. ..... 427/44; 427/54.1

[58] Field of Search ..... 427/35, 36, 44, 54.1

[56] References Cited

U.S. PATENT DOCUMENTS

| | | | |
|---|---|---|---|
| 3,713,935 | 1/1973 | Grecchi | 427/54.1 |
| 3,810,816 | 5/1974 | Zachariadese | 427/44 |
| 3,968,305 | 7/1976 | Oshima et al. | 427/54.1 |

*Primary Examiner*—John H. Newsome

*Attorney, Agent, or Firm*—Antonelli, Terry & Wands

[57] ABSTRACT

A radiation curable coating media can be cured without using a laminating material prepared otherwise by running a continuous belt-like supporter so as to contact a back side of a portion of the substrate with a front side of a portion of the substrate coated with a coating media to form a laminated portion, wherein curing of the coating media is conducted by irradiation with a radiation in the absence of oxygen.

7 Claims, 2 Drawing Figures

PROCESS FOR CURING RADIATION CURABLE COATING MEDIA

BACKGROUND OF THE INVENTION

This invention relates to a process for curing a radiation curable coating media.

Curing reactions by radiation are mainly conducted by radical polymerization, so that there takes place an oxygen inhibition of the reaction on exposure to air. In order to avoid such a trouble, it is general to conduct the curing reaction under an inert gas atmosphere. But this process has the following disadvantages:

(1) Since a large amount of an inert gas is required, the cost of equipment and operating cost become higher.

(2) Since the oxygen concentration changes with an influence of coating speed, it is difficult to control curing properties at a constant level.

In order to improve such disadvantages, it is proposed a process wherein oxygen is excluded by laminating a overlapped material which has been prepared otherwise on a coating media (hereinafter referred to as "the laminating process"). The laminating process has advantages over the above-mentioned process in that the inert gas is not required, and the control of cured properties is easy due to no change in the oxygen concentration caused by coating speed. But the laminating process has the following problems:

(1) It is necessary to prepare various sizes of overlapped materials.

(2) Since the overlapped materials are deteriorated by radiation, there is a limit for re-use. Thus, the overlapped materials should be exchanged in a certain period.

(3) Since special unwinding equipment and winding equipment for the overlapped material are necessary, the cost of equipment becomes higher and a place for such equipments is also required.

SUMMARY OF THE INVENTION

It is an object of this invention to provide a process for curing a coating media by radiation overcoming the problems of the laminating process.

This invention provides a process for curing a radiation curable coating media which comprises running a continuous belt-like substrate so as to contact a back side of the substrate with a front side of a portion of the substrate to form a laminated portion, on where coating a radiation curable coating media on the front side of the substrate, contacting the coating media coated side with the back side of the substrate at the laminated portion to exclude oxygen from the laminated portion, irradiating the coated coating media with a radiation to conduct crosslinking at the laminated portion, and winding up the substrate having the radiation cured coating thereon on a reel.

DESCRIPTION OF THE PREFERRED EMBODIMENTS

Figure 1:
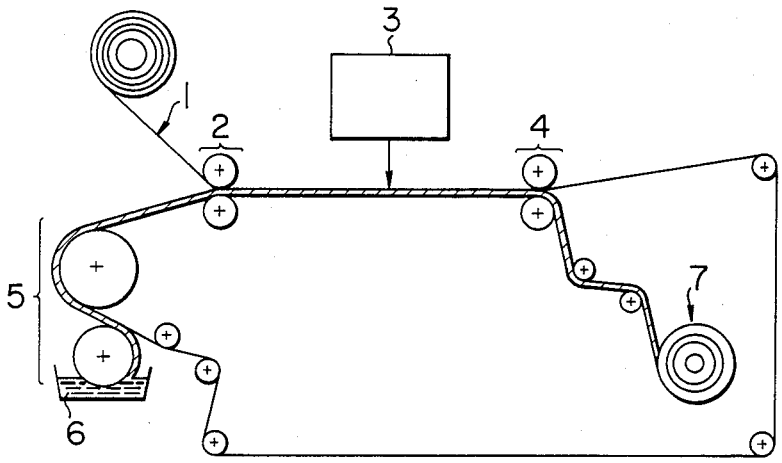
FIG. 1 is a diagrammatic view, arranged in the method of a flow diagram, of apparatus used for one embodiment of the process of this invention.

As the belt-like substrate (hereinafter referred to as "a web"), there can be used continuous webs made from paper, cloth, plastics e.g. polyester film, polypropylene film, polyethylene film, metals, e.g. aluminum foil, cupper foil, etc. (including vacuum metallized tapes), and the like. It is preferable to use webs which hardly absorb radiations and are a little in deterioration by radiations.

Further, since the web should have both good anchor and release properties for the coating media cured by a radiation, it can be surface treated, if necessary, by coating an appropriate undercoating agent on a front side or a releasing agent such as silicone, long-chained alkylester etc. on a back side.

The coating media to be used are adhesives, sticking agents, printing inks which are curable by a radiation. The main component and sometimes one or more additives added thereto should have reactive unsaturated double bonds which bring about the curing reaction by the radiation energy. Examples of the radiation reactive unsaturated double bonds include an acryloyl group, a methacryloyl group, an allyl group, a vinylene group, etc. Considering reactivity, the acrylic double bonds are preferable.

The radiation curable coating media may contain one or more conventionally used polymerization initiators and chain transfer agents for regulating the reactivity, or one or more conventionally used additives depending on purposes.

The radiation usable in this invention includes not only ionizable radiations which are active energy rays such as $\alpha$-rays, $\beta$-rays, $\gamma$-rays, neutron rays, accelerated electron beams, but also ultraviolet rays.

This invention is illustrated referring to the drawings.

FIG. 1 is a diagrammatic view, arranged in the method of a flow diagram, of apparatus used for one embodiment of the process of this invention. A preceding portion of web 1 continuously supplied from a web feed reel runs via laminate rolls 2 and release rolls 4 to a coating apparatus 5, by which a radiation curable coating media solution 6 is continuously coated on a front surface of the web. The coated preceding portion of the web is continuously sent to laminate rolls 2 and release rolls 4, wherein the coated coating media is contacted with a back side of a succeeding portion of the web supplied from the web feed reel to form a laminated portion between the laminate rolls 2 and release rolls 4 so as to exclude oxygen from the laminated portion and at the same time the coating media is subjected to irradiation from a radiation source 3 to conduct curing treatment, and finally the cured portion of the web is released off from the back side of the succeeding web and wound up by a wind-up reel to give a product 7.

Figure 2:
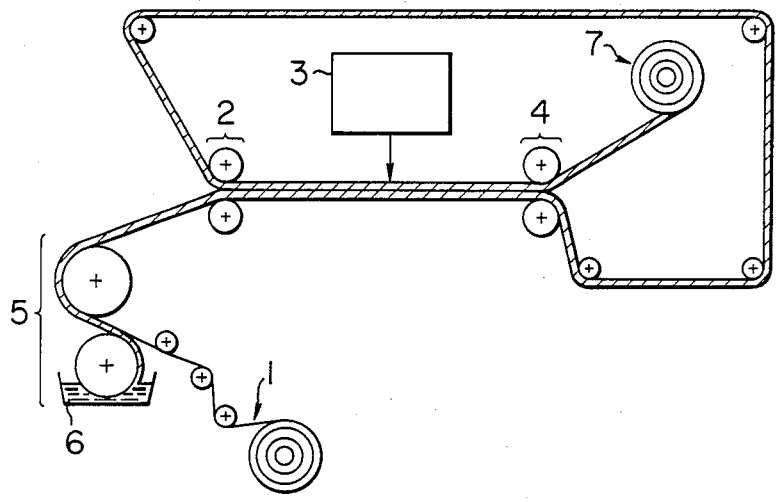
FIG. 2 is a diagrammatic view, arranged in the method of a flow diagram, of apparatus used for another embodiment of the process of this invention.

FIG. 2 shows another embodiment of the process of this invention. A front side of preceding portion of web 1 is first coated with a coating media 6, which is mostly cured by a radiation from a radiation source 3 so as not to stick to laminate rolls 2 and release rolls 4. The mostly cured preceding portion of the web is again sent to the laminate rolls 2 and release rolls 4, wherein a back side of the preceding portion of the web contacts with a coating media coated on a front side of a succeeding portion of the web to form a laminated portion between the laminate rolls 2 and release rolls 4 so as to exclude oxygen from the laminated portion. At the same time, complete curing of the preceding portion and mostly curing of the succeeding portion of the web are conducted by a radiation from the radiation source 3. The back side of the cured preceding portion of the web is separated from the mostly cured media coated front side of succeeding portion of the web and wound up by a wind-up reel to give a product 7. In FIG. 2, numeral 5 denotes a coating apparatus.

As mentioned above, according to this invention, it is not necessary to prepare a overlapped material otherwise for excluding oxygen and it is sufficient to use a roll of web which acts as a overlapped material and as a substrate for coating a coating media thereon. Therefore, it is not necessary to use special unwinding and winding equipment for a overlapped material unlike the known process mentioned above. Further, the process of this invention can be conducted economically effectively and is suitable for industrial production of radiation cured composition coated webs.

This invention is illustrated by way of the following Example.

EXAMPLE 1

A transparent polyester film having a thickness of 50 μm and treated at a back side with releasing agent was used as a web. Using the apparatus as shown in FIG. 1, a radiation curable coating composition was continuously coated on a front side of the operating polyester film at a rate of 10 $g/m^2$ and a laminated portion was continuously irradiated by ultraviolet rays from a high-pressure mercury lamp at a dose rate of $2\times10^4$ $J/m^2$ to cure the coating media. The cured portion of the polyester film were continuously peeled off from a back side of succeeding portion of the polyester film and wound up on a reel to give an adhesive sheet.

What is claimed is:

1. A process for curing a radiation curable coating media which comprises running a continuous belt-like substrate so as to contact a back side of a portion of the substrate with a front side of a portion of the substrate to form a laminated portion, coating a radiation curable coating media on the front side of the substrate, contacting the coating media coated side with the back side of the substrate at the laminated portion to exclude oxygen from the laminated portion, irradiating the coated coating media with a radiation to conduct corsslinking at the laminated portion, and wind up the support having the radiation cured coating thereon on a reel.

2. A process according to claim 1, wherein the front side of substrate coated with a radiation curable coating media is contacted with a back side of succeeding portion of the substrate at the laminated portion.

3. A process according to claim 1, wherein the front side of substrate coated with a radiation curable coating media is contacted with a back side of preceding portion of the substrate having mostly cured coating media on the front side of the substrate at the laminated portion.

4. A process according to claim 1, wherein the radiation is an ionizable radiation or ultraviolet rays.

5. A process for producing an adhesive tape which comprises running a continuous belt-like substrate so as to contact a back side of a portion of the substrate with a front side of a portion of the substrate to form a laminated portion, coating a radiation curable coating media on the front side of the substrate, contacting the coating media coated side with the back side of the substrate at the laminated portion to exclude oxygen from the laminated portion, curing the coating media by irradiating a radiation at the laminated portion, and wind up the support having the radiation cured coating thereon on a reel.

6. A process according to claim 1, wherein said process is conducted continuously.

7. A process according to claim 5, wherein said process is conducted continuously.

* * * * *